United States Patent [19]

Markus

[11] Patent Number: 4,819,986

[45] Date of Patent: Apr. 11, 1989

[54] RECLINING CHAIR WITH SUSPENDED SEATING

[76] Inventor: Isidoro N. Markus, 65-36 99th St.(1E), Rego Park, N.Y. 11374

[21] Appl. No.: 217,823

[22] Filed: Jul. 12, 1988

Related U.S. Application Data

[63] Continuation of Ser. No. 154,336, Feb. 10, 1988.

[51] Int. Cl.[4] ..... A47C 1/02

[52] U.S. Cl. ..... 297/325; 297/276; 297/282

[58] Field of Search ..... 297/276, 277, 280, 281, 297/282, 325

[56] References Cited

U.S. PATENT DOCUMENTS

| | | | |
|---|---|---|---|
| 331,634 | 12/1985 | Hall et al. | 297/325 X |
| 659,300 | 10/1900 | Hann | 297/277 |
| 1,189,393 | 7/1916 | Shaw | 297/276 |
| 1,538,601 | 5/1925 | Talbert | 297/277 |
| 1,965,785 | 7/1934 | Vallone | 297/281 X |
| 2,570,000 | 10/1951 | Lowry | 297/282 |
| 3,591,233 | 7/1971 | Turcksin | 297/276 |
| 4,213,650 | 7/1980 | Sroub | 297/281 |
| 4,351,524 | 9/1982 | Gomes | 297/280 X |

FOREIGN PATENT DOCUMENTS

| | | | |
|---|---|---|---|
| 3421550 | 12/1985 | Fed. Rep. of Germany | 297/325 |

*Primary Examiner*—Peter A. Aschenbrenner
*Assistant Examiner*—Thomas A. Rendos
*Attorney, Agent, or Firm*—Kane, Dalsimer, Sullivan, Kurucz, Levy, Eisele and Richard

[57] ABSTRACT

A reclining chair is provided comprising a frame and a seating secured to said frame by a flexible member. The flexible member passes over and is captured by rolls whereby the seating is suspended from the frame. The flexible member may be affixed at its ends to the frame or the seating and the rolls are affixed to the other of the frame and seating. The frame may be hollow and the flexible members and/or rolls may be positioned within the frame.

4 Claims, 6 Drawing Sheets

RECLINING CHAIR WITH SUSPENDED SEATING

This is a continuation of co-pending application Ser. No. 154,336, filed on Feb. 10, 1988.

BACKGROUND OF THE INVENTION

The present invention relates to reclining chairs, and in particular to such chairs wherein the seating is suspended from the frame by means of flexible members such as cables, plastic or metallic strips, chains, or the like.

The ubiquitous office task chair, normally comprises a spider base with caster wheels, supporting a height adjustable column which is connected at its upper end to a reclining mechanism having a pivotal axis extending from side to side of the seating. The mechanism must further include a powerful spring to keep the seating in an upright position. As a result, any seating position change is acquired and/or retained by the chair user virtually fighting off the spring with its back and legs. The spring is necessary because the center of gravity of the load (seating plus user weight), being above the pivotal axis makes for a very unstable arrangement. Without the spring the seating would slump against the forward stop (upright position), or the backward stop (fully reclined position), and any intermediate position would be impossible to maintain.

Heretofore attempts have been made to improve upon the basic arrangement such as the recliner described in U.S. Pat. No. 3,591,233 and the glider described in U.S Pat. No. 4,213,650. These arrangements could not, however, by effectively utilized for the design of an office task chair.

It is the principal object of the present invention to provide an improved office task chair which does away with the conventional construction described above.

It is a further object to provide such a chair which is comfortable for the user, safe and economical to manufacture.

A still further object of the present invention is to provide a reclining chair wherein the seating is suspended from the chair frame by flexible means which permit a user to change the relative position of the seating with respect to said chair frame.

Yet another object of this invention is to provide an office task chairs the reclining mechanism may easily be hidden from an outside observer thereby greatly enhancing the aesthetics of the chairs appearance.

SUMMARY OF THE INVENTION

The above and other beneficial objects and advantages are attained in accordance with the present invention which comprises a chair frame and rigid seating which is suspended from the frame by means of flexible member or elements such as cables, plastic or metallic strips, chains, or combinations of the above. The seating is supported by the flexible members so as to enable it to rotate with respect to the chair frame there by enabling the user to vary his position from upright sitting to reclining. If desired, caster wheels may be added to the frame to provide the mobility of a conventional task chair.

The seating is supported from above so that in all seating positions the chair is basically stable. The stability of the chair is enhanced by the widely spaced suspension parts of the seating which results in a generous latitude for the center of gravity of the load. In addition, the friction of the flexible members over associated wheels creates a brake force proportional to the load which inhibits further motion once a position is assumed. Therefore, any seating position is easily assumed by a user and retained.

The chair of the present invention permits a simplification of the known art of reclining mechanisms by substituting flexible suspension members for the conventional spring support arrangement. In one preferred embodiment, the adjustment in attitude of the seating is accomplished by providing means for the flexible members to travel with respect to the chair frame.

DETAILED DESCRIPTION OF THE PREFERRED EMBODIMENTS

Figure 1:
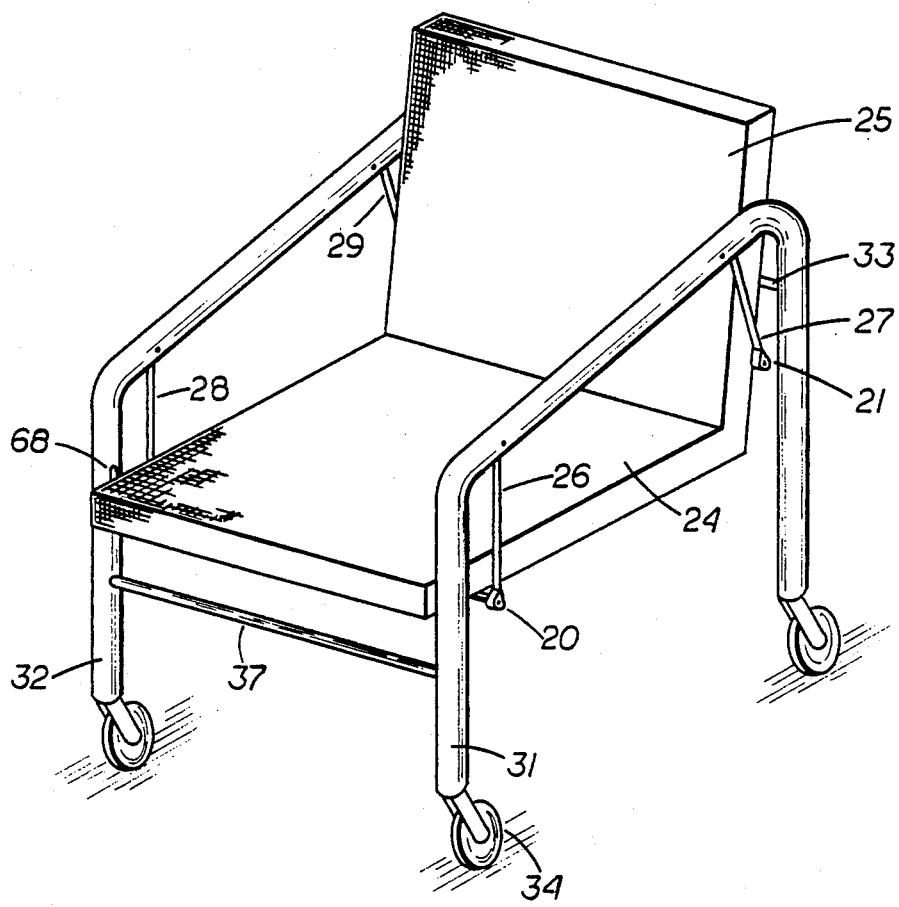
FIG. 1 is a perspective view of a reclining chair in accordance with the present invention.

Referring now in detail to FIG. 1, the task chair 15 of the present invention comprises a supporting metal frame formed of two round tubular side frame members 31,32 each shaped to provide substantially horizontal arm members and substantially vertical leg members. A front cross-rail 37 extends between the frame members 31,32 at the front of the chair and a rear cross-rail 33 extends across the rear of the chair to rigidize the chair frame.

The seating comprises an upholstered seat board 24 and an upholstered back board 25 which are rigidly connected together to each other at an obtuse angle. The seating is suspended from the tubular frame by two flexible members in the form of metallic strips. One flexible member terminating at segments 26 and 27 and the other member terminating at segments 28 and 29. The flexible member ends 26 and 27 engages and support the seating through bushings 20 and 21. Similar bushings (not shown) are provided on the other side of the chair. Caster wheels 34 are securely attached to the chair frame vertical members. As will be described, a slot 68 is machined in the front vertical section of frame member 32 and a similar slot (not shown) is provided on member 31.

It will be understood that the hardware is symmetrically disposed on both sides of the chair. Hence, the hardware on one side only will be described.

Figure 2:
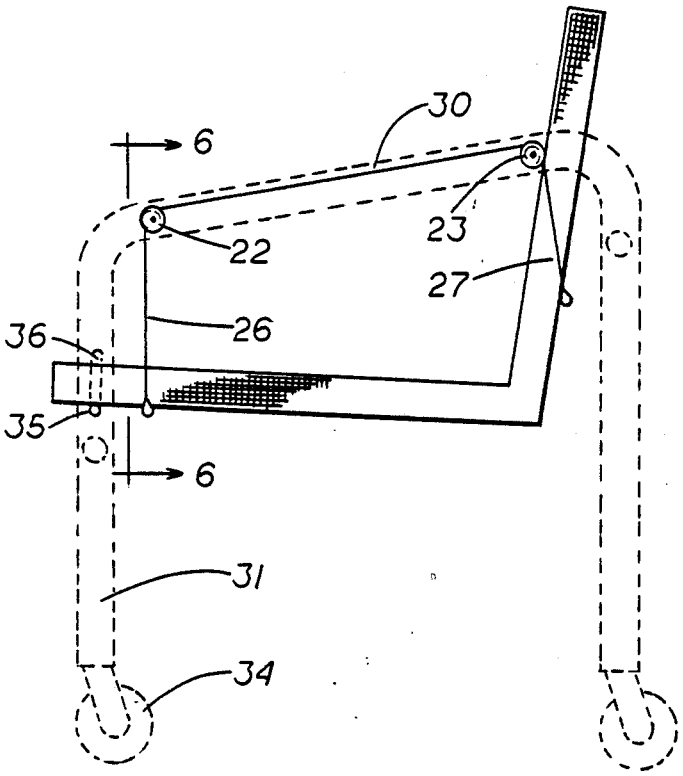
FIG. 2 is a side elevational view of the seating and suspension portions of the chair of FIG. 1 with the seating in an upright position.

Referring now to FIG. 2, it can be seen that wheels 22 and 23 are located inside the upper horizontal portion of the frame member 31 and securely attached by individual shafts to the horizontal portion. The wheels 22 and 23 support and guide the travels of a flexible member 30 disposed lengthwise inside the tube which, passing through corresponding openings on the underside of the horizontal member of side 31, emerging downwardly as front end segment 26 and rear end segment 27. Motion of the seating is accomplished by the flexible member traveling over the wheels as, for example to shift from the position of FIG. 2 to that of FIG. 3 or vice versa.

Figure 6:
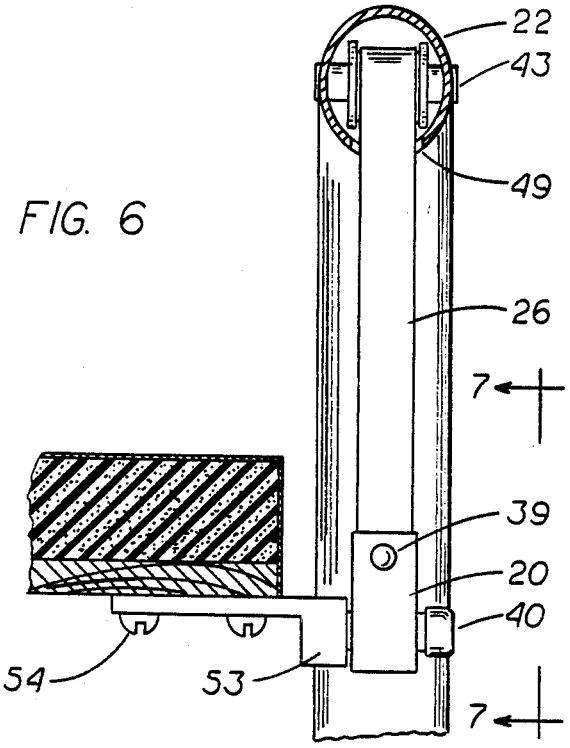
FIG. 6 is a fragmentary sectional view taken along line 6—6 of FIG. 2.
Figure 7:
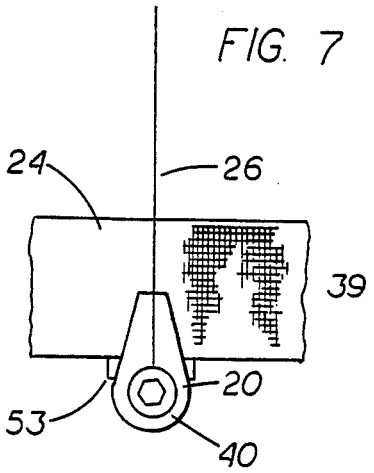
FIG. 7 is a fagmentary side elevational view taken along line 7—7 of FIG. 6.

Referring to FIG. 6, it can be seen that wheel 22 rotates over shaft 43. It can also be seen that wheel 22 has large diameter flanges on both faces to guide the flexible member end 26 and capture it in position. The flexible member end 26 emerges downwardly through a slot 49 and is engaged to the seating by a split type plastic bushing 20 fastened to said flexible member end 26 by rivet 39. A socket head cap shoulder screw 40 acts as a pivotal shaft for bushing 20. A metallic bracket 53 is fastened to the plywood of the seat board 24 by screws 54.

Figure 11:
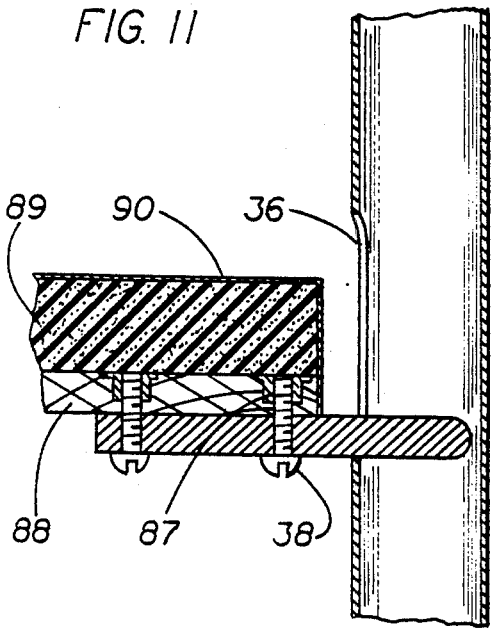
FIG. 11 is a section through the front vertical member on the line 11—11 of FIG. 3.

In FIG. 11 it can be seen that the motion of the seating is guided and limited by a rounded pin 35 which is fastened by screws 38 to the steel inserts 87 of plywood 88. Pin 35 moves within a slot 36 machined on the side of the frame vertical member 31 facing the seating. A foam cushion 89 and a fabric 90 are provided covering said plywood and said foam.

Figure 3:
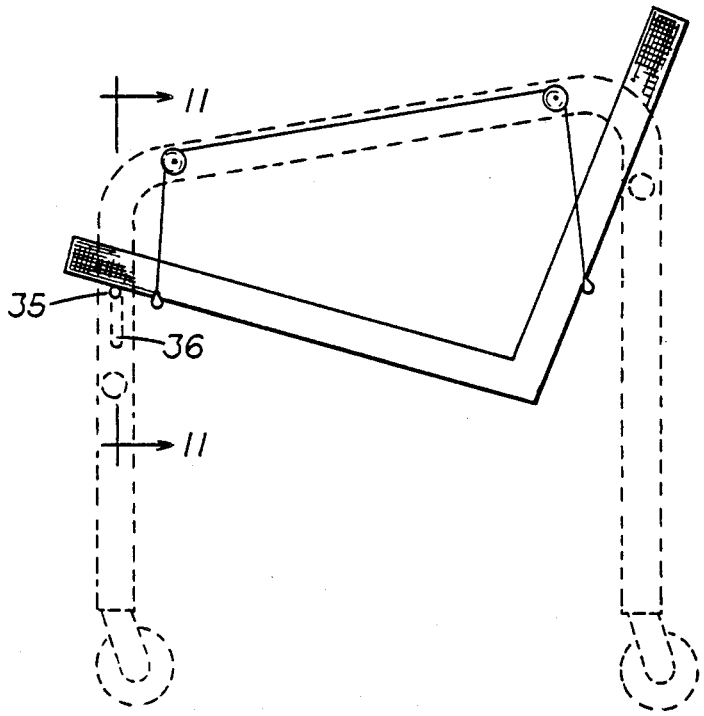
FIG. 3 is a view similar to FIG. 2, with the seating in a fully reclining position.

With the seating in an upright position, as shown in FIG. 1 and FIG. 2, the pin 35 rest against the lower end of slot 36 as shown in FIG. 11 when the seating is in a fully reclined position, as shown in FIG. 3, the pin 35 rest against the upper end of slot 36.

Figure 4:
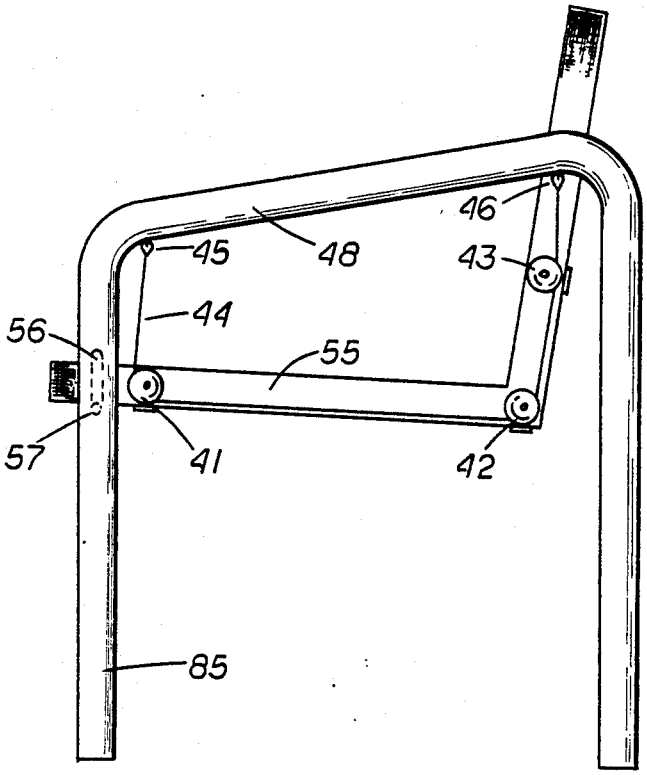
FIG. 4 is a side elevational view of a chair in accordance with the present invention incorporating an alternative suspension and depicting the seating in a sitting or upright position.
Figure 5:
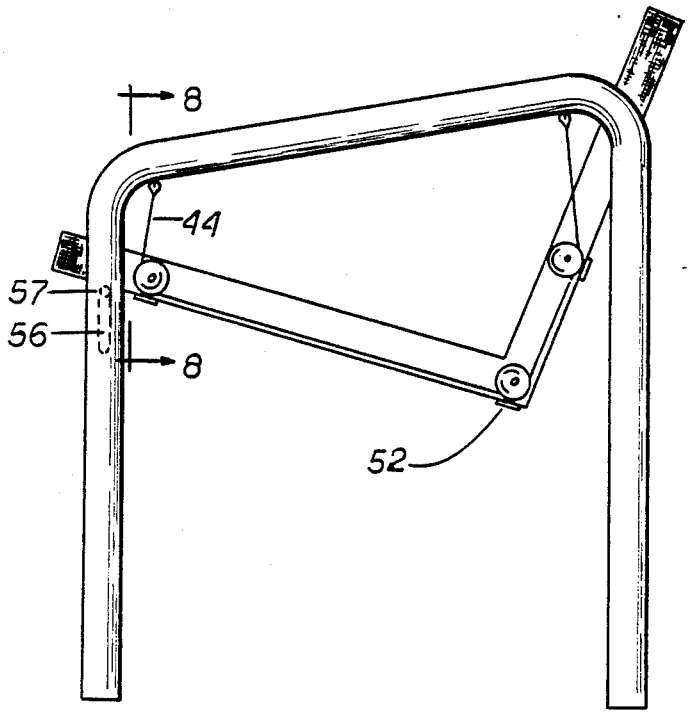
FIG. 5 is a view similar to FIG. 4, but showing the chair in a fully reclining position.

FIG. 4 and FIG. 5 show a different embodiment of my invention, most likely to be used on an inexpensive lounge or side chair where the frame 85 is made of a small diameter tube that would not readily accommodate wheels inside. In this embodiment, wheels 41, 42 and 43 are secured to the side of the seating, and flexible member 44 supports and guide them by running alongside the seating and extending upwardly at both ends. The ends are attached to the upper horizontal member by bushing 45 and 46.

In this embodiment, the motion of the seating is guided and limited by a pin 57 attached to the seat board 55 and running inside slot 56 which is machined on one side of the frame vertical member facing the seating. The operation is thus similar to that of the mechanism showing in FIG. 11.

Figure 8:
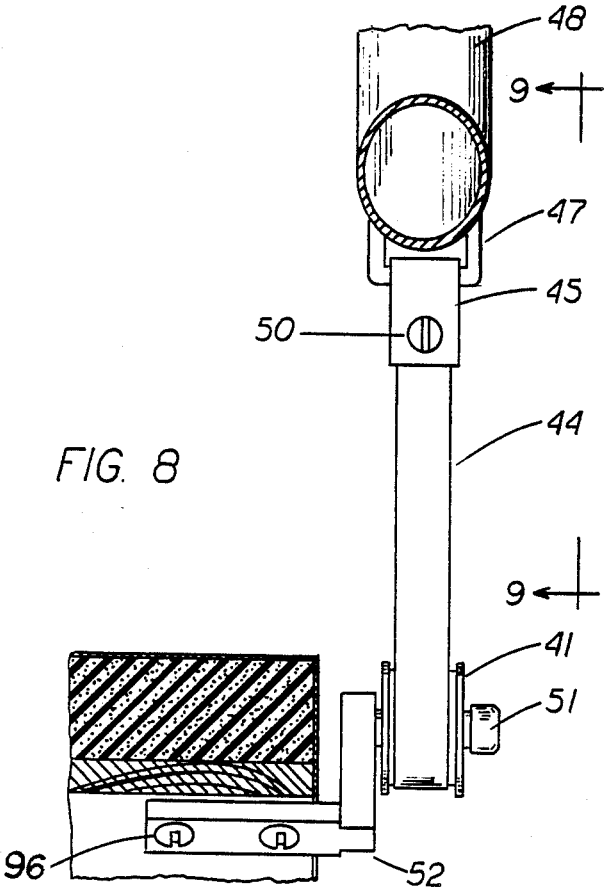
FIG. 8 is a fragmentary sectional view taken along line 8—8 of FIG. 5.
Figure 9:
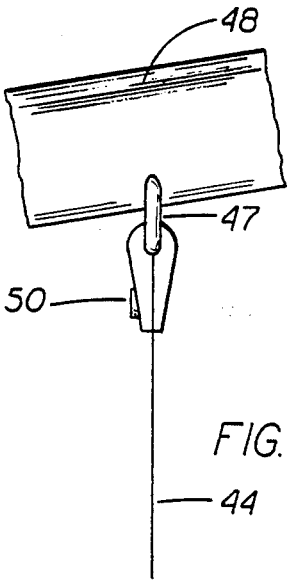
FIG. 9 is a fragmentary side elevational view taken along line 9—9 of FIG. 8.

In FIG. 8 a U-shaped metal clip 47 is welded to the underside of the horizontal member 48 and a split type plastic bushing 45 is then attached to said clip and closed over the end of flexible member 44 by meanss of a screw 50. A plastic wheel 41 rotates over a socket head cap shoulder screw 51, which in turn is fastened to a metallic bracket 52 which is attached by screws 96 to the plywood of the seat board 55. Wheel 41 has large diameter flanges on both faces to avoid derailing from the flexible member over which it travels. Motion of the seating is accomplished by wheels 41, 42 and 43 traveling over said flexible member 44.

Figure 10:
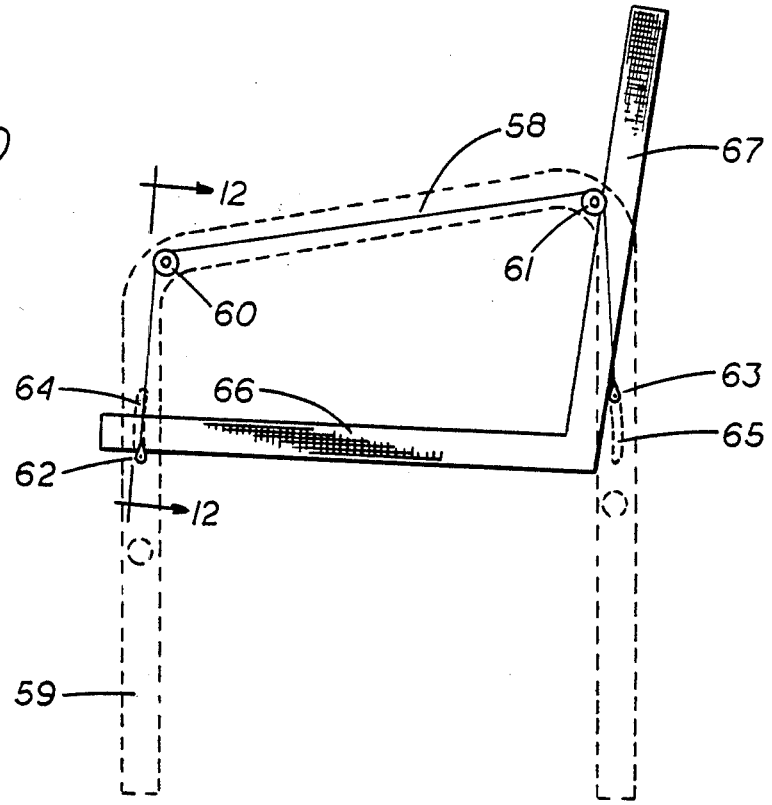
FIG. 10 is a side elevational view of a still different embodiment of a chair in accordance with the present invention depicted in a sitting or upright position.
Figure 12:
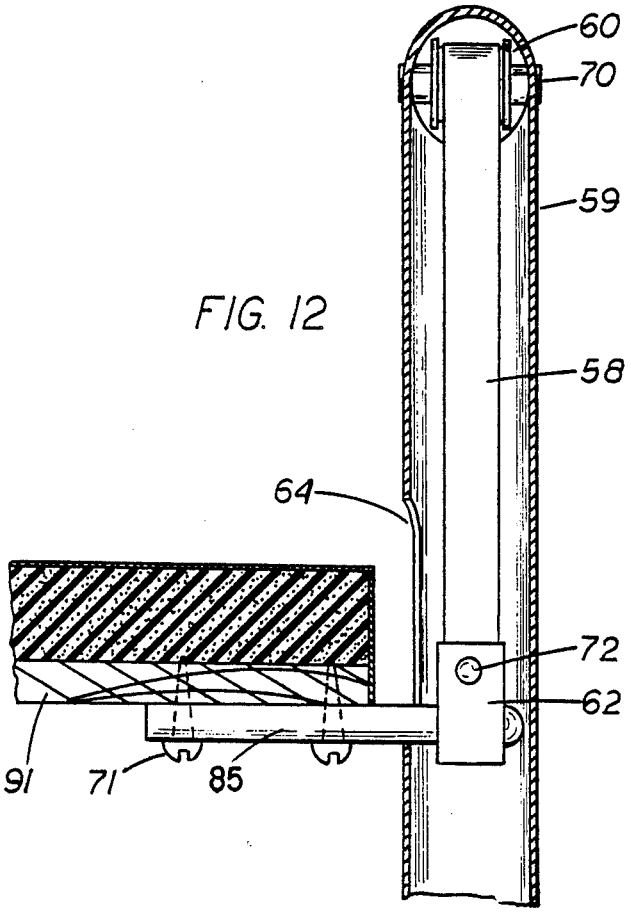
FIG. 12 is a fragmentary sectional view taken along line 12—12 of FIG. 10.

A still different embodiment of the present invention is depicted in FIG. 10 which shows a reclining chair where the flexible member 58 is entirely located inside the tubular frame member 59. In this embodiment wheels 60 and 61 support and guide the flexible member 58. The flexible member ends extend downwardly within the frame vertical members where they are engaged to the seat board 66 by bushing 62, and to the back board 67 by bushing 63. Slots 64 and 65 machined on the side of the vertical members facing the seating as shown in FIG. 12. A plastic free rolling wheel passes over shaft 70 which is press fit into the tube frame 59. In this embodiment, round pin 85 supports the seat board 66 through screws 71 attached to plywood 91 and in turn is supported by the plastic bushing 62, which is riveted to the flexible member 58 by rivet 72. A slot 64 is machined into the frame 59, to guide and limit the motions of the seating.

Figure 13:
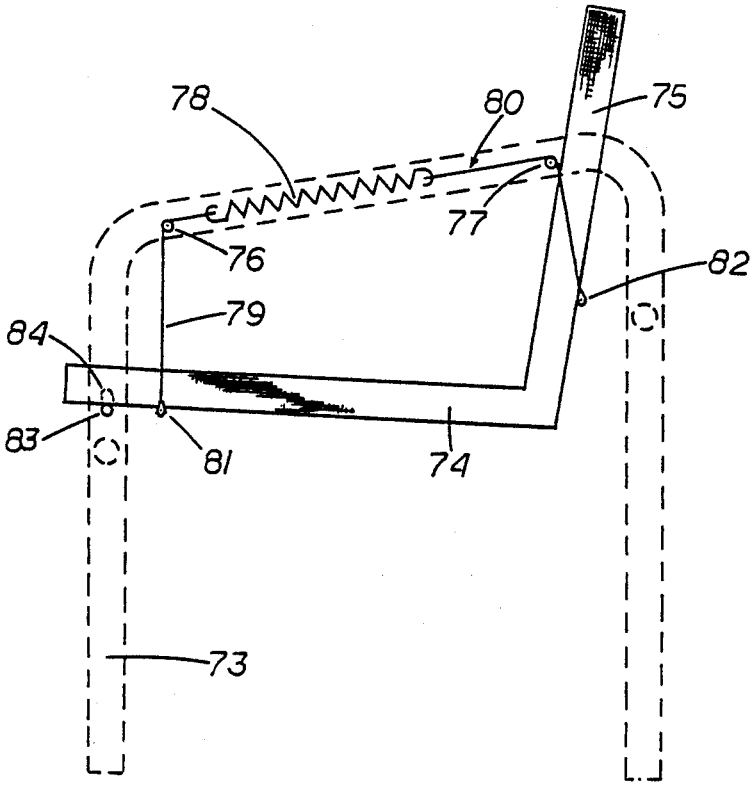
FIG. 13 is a side elevational view of a yet another embodiment of a chair in accordance with the present invention depicted in a sitting or upright position; and, FIG. 14 is a view similar to FIG. 13, but showing the chair in a fully reclining position.

In still another embodiment of my invention, the rotation of the seating is fundamentally altered by providing an elastic flexible member having an extendible feature. Thus, in FIG. 13 the chair comprises a fixed tubular metal frame 73, an upholstered seating comprising a seat board 74 and a back board 75. Wheels 76 and 77 are located inside the tubular frame. Flexible member 79 is connected at one end to bushing 81 and at the other end, through a hole on said flexible member; to a hook at the end of extension spring 78. Similarly, flexible member 80 is connected through a hole in said flexible member to a hook at the other end of extension spring 78 and at the other end to busing 82. In the upright position depicted, a stop pin 83 attached to the seat board 74 rest on the bottom of slot 84.

Figure 14:
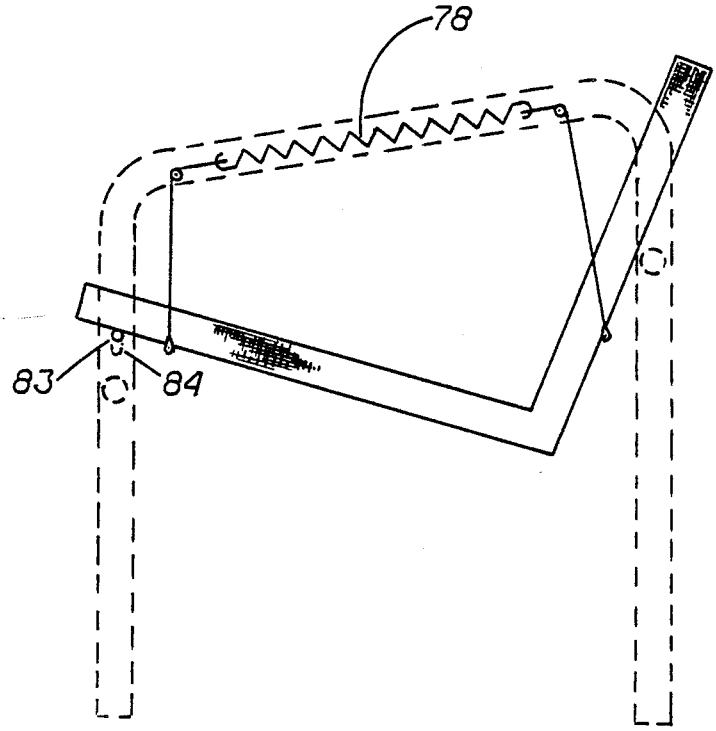

In FIG. 14 the seating is shown in a reclined position with the stop pin 83 attached to the seat board 74 resting against the top of slot 84. The seating rotation to a fully reclined position is accomplished by stretching the extension spring 78.

It will thus be seen that there is provided an apparatus in which the several objects of this invention are achieved and which is well adapted to meet the conditions of novelty and practical use.

Having thus described the invention, what is claimed is:

1. A reclining chair comprising:

a tubular frame having on opposite sides thereof substantially horizontal and vertical members;

a seating disposed within said frame movably supported by said members, said seating comprising a seat board and a back board; and, supporting means on each of said opposite sides for supporting said seating to said frame; said supporting means including: a flexible strap member connected at its ends to said seating and a plurality of guide rolls located inside said tubular frame, said flexible strap being disposed along a path passing over said rolls; a first pin connected to said seat board; a second pin connected to said back board; a first slot in one of said frame members capturing said first pin; and, a second slot in another of said frame members capturing said second pin.

2. The chair in accordance with claim 1 wherein said slots are in said vertical frame members.

3. The chair in accordance with claim 2 wherein said flexible strap is affixed at its ends to said pins.

4. The chair in accordance with claim 1 wherein said flexible strap is affixed at its ends to said pins.

* * * * *